United States Patent [19]

Lillie et al.

[11] 4,310,868

[45] Jan. 12, 1982

[54] FAST CYCLING, LOW POWER DRIVER FOR AN ELECTROMAGNETIC DEVICE

[75] Inventors: James B. Lillie, Longmont; James L. Sanford, Boulder, both of Colo.

[73] Assignee: International Business Machines Corporation, Armonk, N.Y.

[21] Appl. No.: 154,743

[22] Filed: May 30, 1980

[51] Int. Cl.[3] ..... H01H 47/32

[52] U.S. Cl. ..... 361/154; 361/155

[58] Field of Search ..... 361/154, 153, 155, 156

[56] References Cited

U.S. PATENT DOCUMENTS

| | | | |
|---|---|---|---|
| 3,064,165 | 11/1962 | Kennedy | 361/155 |
| 3,558,997 | 1/1971 | Derc | 361/155 |
| 3,582,981 | 6/1971 | Dalyai | 361/155 |
| 3,852,646 | 12/1974 | Mason | 361/154 |
| 4,112,477 | 9/1978 | Sherwin | 361/155 |

*Primary Examiner*—J. D. Miller

*Assistant Examiner*—L. C. Schrock

*Attorney, Agent, or Firm*—Mitchell S. Bigel; Homer L. Knearl; J. Jancin, Jr.

[57] ABSTRACT

A driver for an electromagnetic device, e.g. a solenoid, is capable of driving the device at a fast cycling rate while dissipating minimal power. In response to an actuating signal, a capacitor connected to a high voltage source supplies a high level current to the device for a short time interval until the capacitor is charged. Thereafter, a resistor connected to a low voltage source, supplies a low level current to the device, thus minimizing power dissipation. In response to the cessation of the actuating signal, a transistor connected in parallel with the capacitor turns on, and acts as a low impedance in parallel with the capacitor, to rapidly discharge the capacitor. Once discharged, the capacitor again may supply high level current to the device when the actuating signal is reapplied.

20 Claims, 3 Drawing Figures

FAST CYCLING, LOW POWER DRIVER FOR AN ELECTROMAGNETIC DEVICE

TECHNICAL FIELD

This invention relates generally to a driver circuit for an electromagnetic device, and particularly to a circuit for driving an electromagnetic device at a fast cycling rate, while dissipating minimal power.

Electromagnetic devices of the type used herein include a coil for producing a magnetic field and an armature or plunger movable from a retracted position to an actuated position, in response to a change in the magnetic field. Examples of such electromagnetic devices are relays, actuators or solenoids. A driver supplies the current to energize the coil and produce the magnetic field in response to an actuating signal.

It is well known that a large current is required to pick an electromagnetic device, i.e., to move the plunger or armature from its retracted position to its actuated position. This large current is referred to herein as the pick current. Once the device is in its actuated position, a smaller current will suffice to maintain the device actuated. This smaller current is referred to herein as the hold current.

In order to minimize power dissipation in an electromagnetic device and prevent excessive device heating, it is desirable that the driver supply a pick current to the coil for a sufficient time to pick the device, and thereafter supply a smaller hold current to maintain the device actuated. However, the reduction of power dissipated in the device during the hold interval must not be accompanied by an increase in the power dissipated in the driver circuit itself. Since driver circuitry is typically mounted on a printed circuit board, power dissipation in the driver itself must be kept to a minimum to prevent overheating and failure of the printed circuit board.

In modern applications, electromagnetic devices are often required to cycle at a rapid rate. When such a device is actuated and then retracted, it must be available for reactuation in a minimal amount of time. The plunger or armature in the electromagnetic device itself returns to its retracted position, under the influence of a spring, gravity and/or other means almost immediately when the driver ceases to supply current to the coil. The device itself is then available to be reactuated. However, the driver circuit must also be reset at the end of a pick and hold cycle. The driver circuitry must be brought back to its initial circuit conditions before a new pick and hold cycle may be initiated. If the driver cannot be reset quickly enough, the overall cycling rate of the electromagnetic device will be inadequate for modern applications.

BACKGROUND ART

The electromagnetic device drivers of the past have not adequately solved the dual problem of low power dissipation and fast reset time. For example, in FIG. 3 of U.S. Pat. No. 3,558,997, a driver circuit is shown wherein both pick and hold currents are supplied by high power circuits connected to a high voltage power supply. Although lower power is dissipated in the coil during hold mode, high power is still dissipated in the driver circuit during hold mode because of the high voltage power supply connection. Further, there are no means provided for rapidly resetting the driver circuit to make it rapidly available for a subsequent pick and hold cycle. Additionally, the driver requires separate pick and hold signals to regulate the duration of the pick and hold intervals respectively, rather than a single actuating signal for both pick and hold.

Another prior art driver described in U.S. Pat. No. 3,582,981 utilizes the charge stored on a capacitor to provide a pick current for a short interval until the charge on the capacitor is dissipated. A smaller hold current is then supplied by a transistor. At the conclusion of an actuating cycle, the driver cannot be reactuated until a charge is again built up on the capacitor. The capacitor is connected to the power supply by a high impedance. The time to recharge the capacitor is therefore long. No means are provided for rapidly returning the capacitor to its initial charged state by rapidly recharging it, and therefore the device cycling rate is low. Further, even if the capacitor was connected to the power supply by a low impedance, to thereby increase the charging speed, the power dissipation of the driver circuit would increase dramatically, as the low impedance would draw a high current from the power supply during the pick and hold intervals.

DISCLOSURE OF INVENTION

It is an object of the invention to provide an improved driver for an electromagnetic device.

It is another object of the invention to provide a driver for an electromagnetic device which provides a high pick current to actuate the device in response to an actuating signal, and then provides a low hold current to maintain the device actuated for the duration of the actuating signal.

It is another object of the invention to provide a fast cycling driver; i.e., a driver for an electromagnetic device which is reset rapidly to its initial state when the actuating signal ceases, so that when the actuating signal again commences, a new pick and hold cycle may begin immediately when the actuating signal again commences.

These and other objects are accomplished by a driver circuit for an electromagnetic device wherein picking means supplies pick current from a high energy source to the device, in response to an actuating signal, for a short time interval until the picking means fills with energy. After this short time interval, hold means supplies a hold current from a low energy source to the device for as long as the actuating signal remains present. When the actuating signal ceases, deenergizing means is connected to the picking means to rapidly dissipate the energy stored in the picking means during the pick interval, and thus rapidly renders the driver available for reenergizing the device.

Since the holding means is coupled to a low power supply, minimal power is dissipated in the driver during the hold mode. And by providing means for rapidly dissipating the energy stored in the picking means during the pick interval, the driver is rapidly reset and made available for reactuating the device.

In the specific embodiment disclosed, a first (switching) transistor is connected to one terminal of the device, and acts as a switch, responsive to the presence or absence of the actuating signal to permit or inhibit, respectively, the operation of the picking and holding means. The picking means is a capacitor connected to a high voltage power supply and the other terminal of the device. The holding means is a resistor connected to a low voltage supply, and the other terminal of the device. The deenergizing means is a second (deenergizing) transistor connected in parallel with the pick capacitor.

Operation of the driver circuit is as follows. Initially the pick capacitor is uncharged. In response to the actuating signal, the switching transistor turns on. A large current flows across the pick capacitor from the high voltage supply and through the device, thus picking the device. The pick capacitor rapidly charges and the pick current consequently decreases rapidly. A small holding current is then supplied from a low voltage supply by means of the holding resistor, to maintain the device activated. Since the hold current is small, and derived from a low voltage supply, the power dissipation in the driver is low, for the duration of the hold interval.

When the actuating signal is removed, the switching transistor turns off and the device discharges through a suppression diode. The deenergizing transistor turns on in response to the switching transistor turning off. Since the deenergizing transistor is connected in parallel with the pick capacitor, it acts as a low impedance in parallel with the capacitor and rapidly dissipates the charge accumulated on the pick capacitor during the pick interval, thus resetting the pick capacitor to its initial uncharged state. Once the capacitor has been discharged, the deenergizing transistor turns off and the driver circuit is ready to begin a new cycle.

BEST MODE FOR CARRYING OUT THE INVENTION

Figure 1:
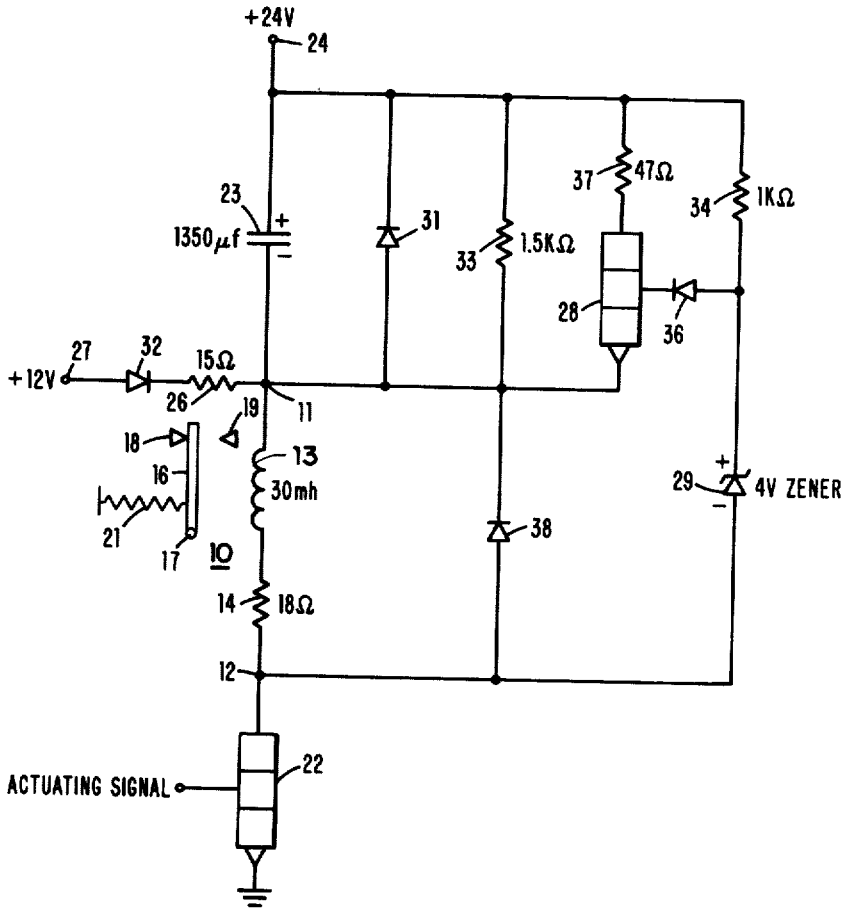
FIG. 1 is a circuit diagram of the improved electromagnetic driver of the invention.

In the embodiment shown in FIG. 1, electromagnetic device 10 is a solenoid, represented electrically by solenoid inductance 13 and solenoid resistance 14. The solenoid armature or plunger mechanism is shown diagramatically; i.e., a pivotally mounted armature/-plunger 16 at pivot 17, biased towards stop 18 by spring 21 when deactuated, and shifted against stop 19 when actuated. The upper terminal of the solenoid will be referred to as node 11 and the lower terminal as node 12. Switching transistor 22 is connected between node 12 and ground. Pick capacitor 23 is connected between high voltage power supply 24 and node 11. Holding resistor 26 is connected between low voltage power supply 27 and node 11. Deenergizing transistor 28 is connected in parallel with pick capacitor 23, and connected to node 12 through Zener diode 29. Diode 31 protects pick capacitor 23 from abnormal voltage transients.

In the absence of an actuating signal at the base of switching transistor 22, transistor 22 is off. The voltage across capacitor 23 is zero. Diode 32 is reversed biased. The voltage at node 11 is equal to the voltage of high voltage power supply 24. No current flows through pick capacitor 23, holding resistor 26, or solenoid 10.

When it is desired to actuate the solenoid, an actuating signal is impressed at the base of switching transistor 22 to turn 22 on. With 22 on, a high current rapidly builds up in solenoid 10 due to the solenoid time constant defined as the value of solenoid inductance 13 divided by the value of solenoid resistance 14. In the design of the present driver circuit, the time constant of the pick capacitor circuit, defined by the value of resistor 14 times the value of capacitor 23, is chosen to be much greater than the time constant of the solenoid. The voltage across capacitor 23 therefore remains small as the solenoid current builds up to a maximum. The maximum solenoid current is approximately the value of high voltage power supply 24 divided by the value of solenoid resistance 14 (neglecting the small capacitor voltage). As pick capacitor 23 charges due to the current flow through it, the voltage across pick capacitor 23 increases. As the voltage across the capacitor increases, the voltage at node 11 decreases and the solenoid current decreases.

It is important to note that the combination of the solenoid inductance 13, resistance 14 and pick capacitor 23 form a series tank circuit and may resonate. Therefore the values of 13, 14, and 23 must be chosen to give a low Q, so that circuit instability due to resonance will not occur.

When the voltage at node 11 decreases to the point where it is just below the voltage of low voltage power supply 27, diode 32 begins to conduct and the hold current begins to build up. As pick capacitor 23 continues to fill with charge, the current in the capacitor approaches zero and the voltage across the capacitor approaches a steady-state value. The voltage at node 11 continues to drop and the hold current increases to a steady state. The value of the steady state hold current is given by the value of low voltage power supply 27 divided by the sum of resistances 14 and 26, neglecting current through resistor 33 and the voltage drops across diode 32 and transistor 22. Thus the magnitude of the hold current can be controlled by the value of resistor 26.

As steady state hold, no current flows through pick capacitor 23. The hold current flows through 26 and the solenoid, and the voltage across pick capacitor 23 is given by the difference between the value of the high voltage power supply 24 and the voltage of node 11. Zener diode 29 and resistors 33 and 34 are chosen such that at steady state hold, the voltage between the base of deenergizing transistor 28 and node 12, corresponding to the voltage drops across diode 36 and 29, is less than the voltage at node 11. Transistor 28 is thus off. No current flows through transistor 28, as it appears as a high impedance when off.

The steady state hold conditions described above remain as long as the actuating signal persists at the base of 22. During steady state hold, power dissipation in the driver is substantially limited to the power dissipated in resistor 26, although a very small amount of power is dissipated in resistors 33 and 34. No current flows through resistor 37. Since the hold current is derived from low voltage supply 27, power dissipation in resistor 26 is minimized.

To retract the solenoid the actuating signal is removed from the base of transistor 22 thereby turning 22 off. The current in the solenoid discharges through suppression diode 38 and the solenoid armature retracts under the influence of a spring or gravity as the magnetic field in the coil collapses. Zener diode 29 no longer conducts in the reverse direction and is not sufficiently biased for conduction in the forward direction, so that deenergizing transistor 28 is biased by resistor 34 and saturates. As is well known, when a transistor saturates, its output impedance is very low. Thus transistor 28, when saturated, is a very low impedance in parallel with pick capacitor 23. In a particular circuit design, in order to insure that transistor 28 saturates, current limiting resistor 37 may be necessary. The ratio of resistor 34 to resistor 37 must be less than the $\beta$ of transistor 28. When a current limiting resistor is used, the combination of current limiting resistor 37 and saturated deenergizing transistor 28 appear as a low impedance across pick capacitor 23. Capacitor 23 rapidly discharges across the low impedance. The voltage across capacitor 23 decays rapidly to a value approaching zero. Deenergizing transistor 28 turns off, and again is a high impedance with respect to capacitor 23. The remaining charge on 23, if any, continues to dissipate through 33 if necessary.

By coupling the turning on of transistor 28 with the turning off of transistor 22, consequent upon the cessation of the actuating signal, a low impedance in the form of turned on transistor 28 is connected across the terminals of capacitor 23. The charge built upon capacitor 23 during the pick interval is rapidly dissipated through transistor 28. Once this charge dissipates, a large pick current may again flow through capacitor 23 when an actuating signal is again impressed at the base of transistor 28. It should be noted that transistor 28 is only a low impedance (i.e., transistor 28 is on) during the time interval required to discharge pick capacitor 23. At all other times, i.e., during pick and hold intervals, and during the interval when the solenoid driver is inactive transistor 28 is off and is a high impedance, thus minimizing its power dissipation.

It is to be noted that if transistor 28 were replaced by a low valued resistor which acted as a constant low impedance, pick capacitor 23 would discharge very rapidly during reset, however, the power dissipation in the low valued resistor would be very high during pick and hold modes as there would be a large voltage across it. By utilizing deenergizing transistor 28 which alternately appears as a high and a low impedance, discharge time is minimized while power dissipation is also minimized.

Figure 2:
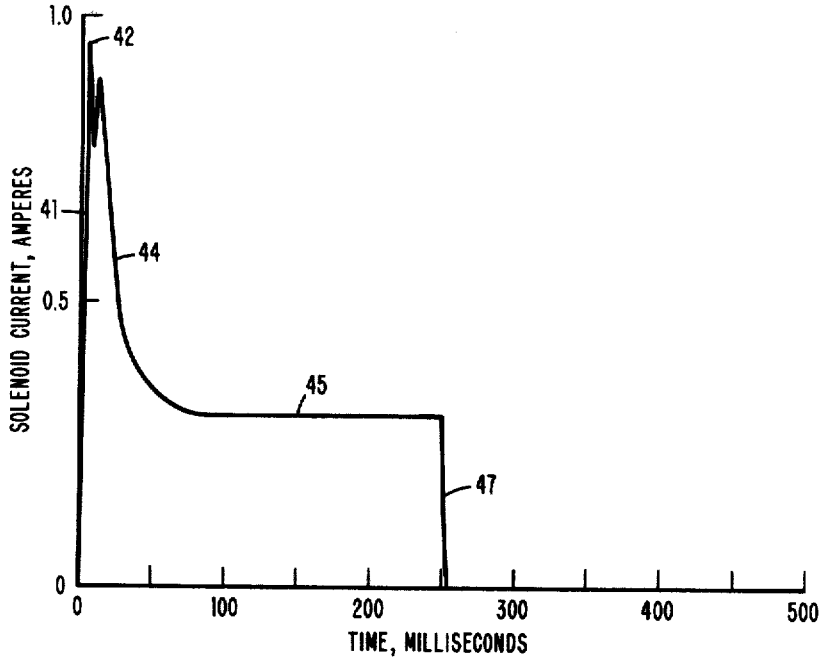
FIG. 2 is a waveform plot of the current in the electromagnetic device over a driver cycle.
Figure 3:
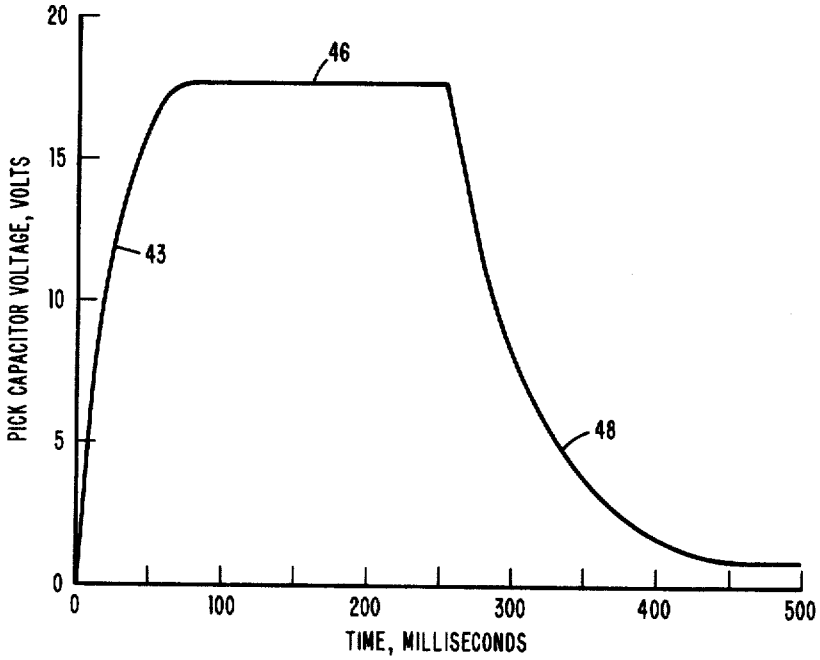
FIG. 3 is a waveform plot of the voltage across the pick capacitor over a driver cycle.

FIGS. 2 and 3 are plots of waveforms from the driver of FIG. 1. The solenoid inductance 13 is 30 mh, and the solenoid resistance 14 is 18 ohms. The actual component values employed are given in FIG. 1 in parentheses adjacent to components.

FIG. 2 is a waveform plot of the current in the solenoid for an entire actuating cycle. At zero milliseconds the actuating signal turns switching transistor 22 on. The current in the solenoid rapidly rises in accordance with the time constant of the solenoid, here 30 mh/18 ohm. As shown in segment 41 of FIG. 2 the pick current rises to a maximum value at point 42 in about 10 ms. It will be noted that there is a dip in the peak pick current caused by an increase in the inductance of the solenoid as the solenoid picks.

Referring to segment 43 of FIG. 3, it will be seen that during the pick interval the voltage across pick capacitor 23 rises slowly in accordance with the solenoid resistance 14 times pick capacitor 23 time constant. The capacitor voltage is initially zero and rises to a peak voltage of about 18 volts. As the capacitor voltage rises, the solenoid current decreases proportionately. The drop in the solenoid current, shown in segment 44 of FIG. 2, is thus also governed by the solenoid resistance 14 times pick capacitor 23 time constant. For the component values shown in FIG. 1, the pick interval lasts for about 50 ms.

At about 50 milliseconds, the hold period begins. To generate FIGS. 2 and 3, the actuating signal was maintained on transistor 22 for 250 ms. It will be seen from segment 45 of FIG. 2 that during the hold period, the solenoid current is a constant 0.3 amp. During the hold period the voltage across pick capacitor 23 remains at its peak value as shown at segment 46 of FIG. 3.

At 250 ms. the actuating signal is removed. Switching transistor 22 turns off. The solenoid current rapidly discharges through diode 38 and rapidly falls to zero (see segment 47 of FIG. 2). Transistor 28 is turned on, and the capacitor voltage is rapidly discharged with a time constant given by resistor 37 times pick capacitor 23, as shown in FIG. 3 at segment 48. At about 450 ms the capacitor voltage is so low that 28 turns off. It will be seen from FIG. 3 that the pick capacitor discharges in the 250–450 ms time interval. About 200 ms after the actuating signal is removed, as new actuating signal may commence and a new pick and hold cycle begin.

The following observations are made from the waveforms of FIGS. 2 and 3: The power dissipation during the hold interval is reduced by the use of low voltage power supply 27 and resistor 26. The power dissipated in the driver during hold mode is given by the hold current squared times resistor 26, or about 1.3 watts. Had the low voltage power supply not been used, the value of 33 would have to be made very low in order to supply the required 300 ma hold current, and 33 would dissipate a much higher amount of power, precluding the use of printed circuit construction for the driver. It will also be seen, that were deenergizing transistor 28 not present, pick capacitor 23 would discharge at the rate determined by the resistor 33 times capacitor 23 time constant. This is much larger than the resistor 37 times capacitor 23 time constant produced when transistor 28 is on. With the component values of FIG. 1, this difference is at least a factor of 10, as resistor 33 is less than 30 times the value of resistor 37.

It will be seen by those skilled in the art that the driver of FIG. 1 may be used with any electromagnetic device; the component values chosen to give a required pick and hold current with a given high and low voltage power supply, to provide the advantages of minimal power dissipation and fast cycling time. It will also be seen, that if the gain of the energizing transistor 28 is sufficiently high, suppression diode 38 may be eliminated, and the solenoid current may discharge directly into transistor 28 rather than suppression diode 38. The solenoid current is then used to directly drive transistor 28 into saturation and thereby discharge pick capacitor 23.

Whereas we have illustrated and described the various embodiments of our invention it is to be understood that we do not limit ourselves to the precise construction herein disclosed and the right is reserved to all changes and modifications coming within the scope of the invention as defined in the appended claims.

We claim:

1. A circuit for actuating an electromagnetic device at a rapid cycling rate in response to an actuating signal by utilizing energy from a high energy source and a low energy source comprising:

picking means, electrically connected between the high energy source and said device, for actuating said device by coupling the high energy source to said device for a short time interval until said picking means fills with energy;

holding means, electrically connected between the low energy source and said device, for maintaining said device actuated by coupling the low energy source to said device after expiration of the short time interval;

switching means responsive to the actuating signal for enabling said picking means and said holding means for the duration of the actuating signal, and for disabling said picking means and said holding means upon the cessation of the actuating signal; and deenergizing means responsive to said switching means upon the cessation of the actuating signal, for rapidly dissipating the energy stored in said picking means whereby said picking means is rapidly made available to couple the high energy source to said device when subsequently enabled by said switching means.

2. The circuit of claim 1 wherein said picking means is a capacitor, one terminal of which is connected to the high energy source and the other terminal of which is connected to said device.

3. The circuit of claim 1 wherein said holding means is a resistor, one terminal of which is connected to the low energy source and the other terminal of which is connected to said device.

4. The circuit of claim 1 wherein said deenergizing means connects a low impedance to said picking means, for rapidly dissipating the energy stored in said picking means through the low impedance.

5. The circuit of claim 1 wherein said switching means is a first transistor, connected between said device and ground, for creating a path from said device to ground for the duration of the actuating signal and for breaking the path from said device to ground upon cessation of the actuating signal.

6. The circuit of claim 5 wherein said deenergizing means is a second transistor connected to said picking means, for rapidly dissipating the energy stored in said picking means through said second transistor when said first transistor breaks the path from said device to ground.

7. A driver for driving an electromagnetic device in response to an actuating signal comprising:

picking means electrically connected to said device for energizing said device at a high energy level to actuate said device, said picking means operating over a short time interval until said picking means fills with energy;

holding means electrically connected to said device for subsequently energizing said device at a low energy level to maintain said device actuated;

switching means responsive to the actuating signal for enabling said picking means and said holding means for the duration of the actuating signal and for disabling said picking means and said holding means upon the cessation of the actuating signal; and means electrically connected to said picking means for rapidly deenergizing said picking means consequent upon the aforesaid disabling of said picking means and said holding means whereby said picking means is rapidly made available to energize said device.

8. The driver of claim 7 wherein said means for rapidly deenergizing said picking means connects a low impedance to said picking means, said low impedance rapidly dissipating the energy stored in said picking means.

9. A circuit for driving a two terminal electromagnetic device in response to an actuating signal by utilizing energy from a low voltage source and a high voltage source comprising:

a capacitor, connected between the first terminal of said device and the high voltage source, for providing a large first current flow through the capacitor and through said device so as to actuate said device, the magnitude of the first current decreasing as said capacitor becomes fully charged due to the first current flow therethrough;

a first resistor, connected between said first terminal of said device and the low voltage source, for providing a small second current flow through said first resistor and through said device so as to maintain said device actuated;

a first transistor, connected to the second terminal of said device, and responsive to the actuating signal, for enabling the flow of the first current and the second current through said device in response to the actuating signal and for inhibiting the flow of the first current and the second current through said device in the absence of the actuating signal; and a second transistor, connected to said first transistor and in parallel with said capacitor such that said second transistor is activated and acts as a low impedance in parallel with said capacitor, for rapidly discharging said capacitor through the low impedance consequent upon said first transistor inhibiting the flow of the first current and the second current through said device.

10. The circuit of claim 9 wherein said first transistor is a transistor, the collector of which is connected to said second terminal of said device, the emitter of which is connected to ground and the base of which is connected to said actuating signal.

11. The circuit of claim 9 wherein said second transistor is a transistor, the collector of which is connected to the high voltage source, the emitter of which is connected to said first terminal of said device, and the base of which is connected to the collector of said first transistor.

12. The circuit of claim 9 wherein said device is a solenoid.

13. The circuit of claim 9 further including a diode connected between said resistor and the low voltage source, to block the flow of the second current until the magnitude of the first current decreases to a predetermined value.

14. The circuit of claim 9 further including a diode connected between said first terminal of said device and said second terminal of said device, whereby the current in said device is dissipated in the circuit loop formed by said diode and said device consequent upon said first transistor inhibiting the flow of the first current and the second current through said device.

15. The circuit of claim 14 further including a second low impedance resistor, connected between the collector of said second transistor and the high voltage power supply, for current limiting said second transistor and for discharging said capacitor when said second transistor is activated.

16. A circuit for actuating an electromagnetic device at a rapid cycling rate in response to an actuating signal by utilizing energy from a high energy source and a low energy source comprising:

picking means, electrically connected between the high energy source and said device, for actuating said device in response to the actuating signal by coupling the high energy source to said device for a short time interval until said picking means fills with energy;

holding means, electrically connected between the low energy source and said device, for maintaining said device actuated in response to the actuating signal by coupling the low energy source to said device from the end of said short time interval until the cessation of the actuating signal; and deenergizing means, electrically connected to said picking means, for rapidly dissipating the energy stored in said picking means during said short time interval in response to the cessation of said actuating signal whereby said picking means is rapidly made available to couple the high energy source to said device when the actuating signal is reapplied.

17. The circuit of claim 16 wherein said picking means is a capacitor, one terminal of which is connected to the high energy source and the other terminal of which is connected to said device.

18. The circuit of claim 16 wherein said holding means is a resistor, one terminal of which is connected to the low energy source and the other terminal of which is connected to said device.

19. The circuit of claim 16 wherein said deenergizing means connects a low impedance to said picking means, said low impedance rapidly dissipating the energy stored in said picking means.

20. The circuit of claim 16 wherein said deenergizing means is a transistor connected to said picking means which acts as a low impedance for rapidly dissipating the energy stored in said picking means.

* * * * *